United States Patent [19]

Bloom et al.

[11] 4,088,487

[45] May 9, 1978

[54] DIFFUSION TRANSFER INTEGRAL FILM UNITS WITH FLARE REDUCING LAYERS

[75] Inventors: Stanley M. Bloom, Waban; Howard G. Rogers, Weston, both of Mass.

[73] Assignee: Polaroid Corporation, Cambridge, Mass.

[21] Appl. No.: 807,142

[22] Filed: Jun. 16, 1977

Related U.S. Application Data

[63] Continuation of Ser. No. 554,741, Mar. 3, 1975, abandoned.

[51] Int. Cl.[2] ..... G03C 1/40; G03C 7/00; G03C 1/84; G03C 5/54

[52] U.S. Cl. ..... 96/29 D; 96/3; 96/29 R; 96/73; 96/74; 96/76 R; 96/77; 96/84 R

[58] Field of Search ..... 96/3, 29 D, 77, 84 R, 96/76 R, 73, 74, 29 R

[56] References Cited

U.S. PATENT DOCUMENTS

| | | | |
|---|---|---|---|
| 2,966,408 | 12/1960 | Land | 96/84 R |
| 3,351,470 | 11/1967 | McCune | 96/3 |
| 3,647,437 | 3/1972 | Land | 96/3 |
| 3,793,023 | 2/1974 | Land | 96/77 |
| 3,833,368 | 9/1974 | Land et al. | 96/77 |

*Primary Examiner*—Edward C. Kimlin
*Assistant Examiner*—Richard L. Schilling
*Attorney, Agent, or Firm*—Stanley H. Mervis

[57] ABSTRACT

Diffusion transfer integral film units are provided having a flare-reducing layer adjacent or contiguous the photosensitive silver halide layer(s).

37 Claims, 1 Drawing Figure

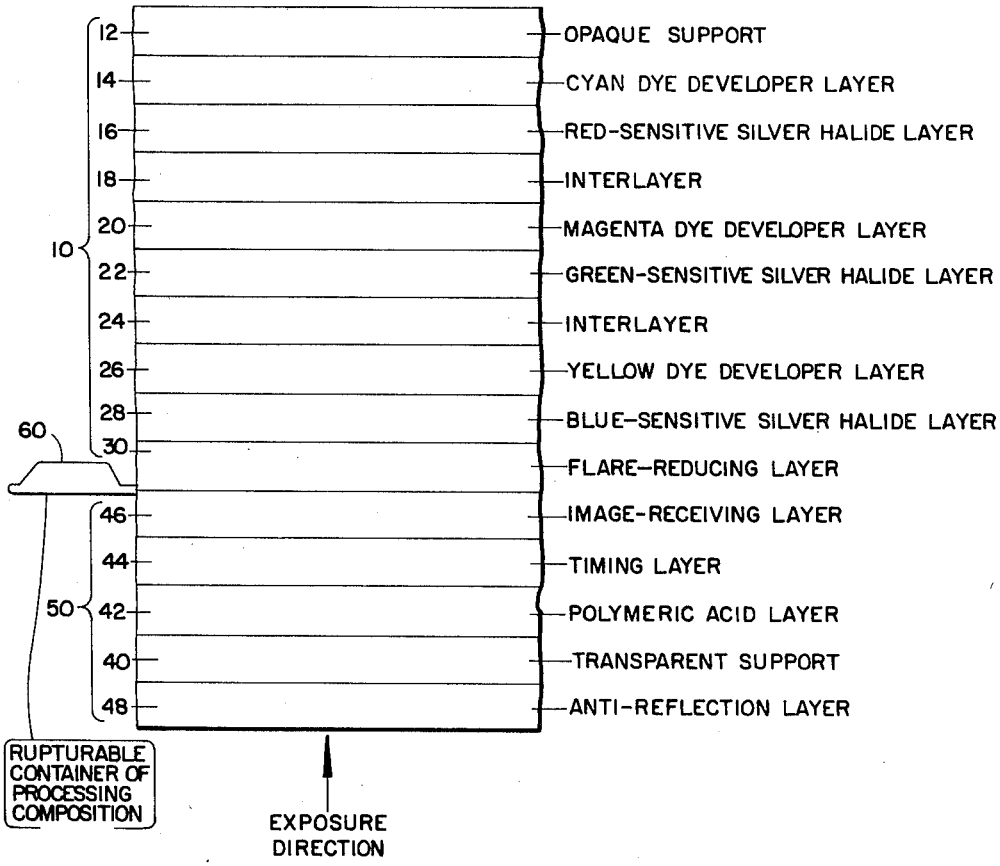

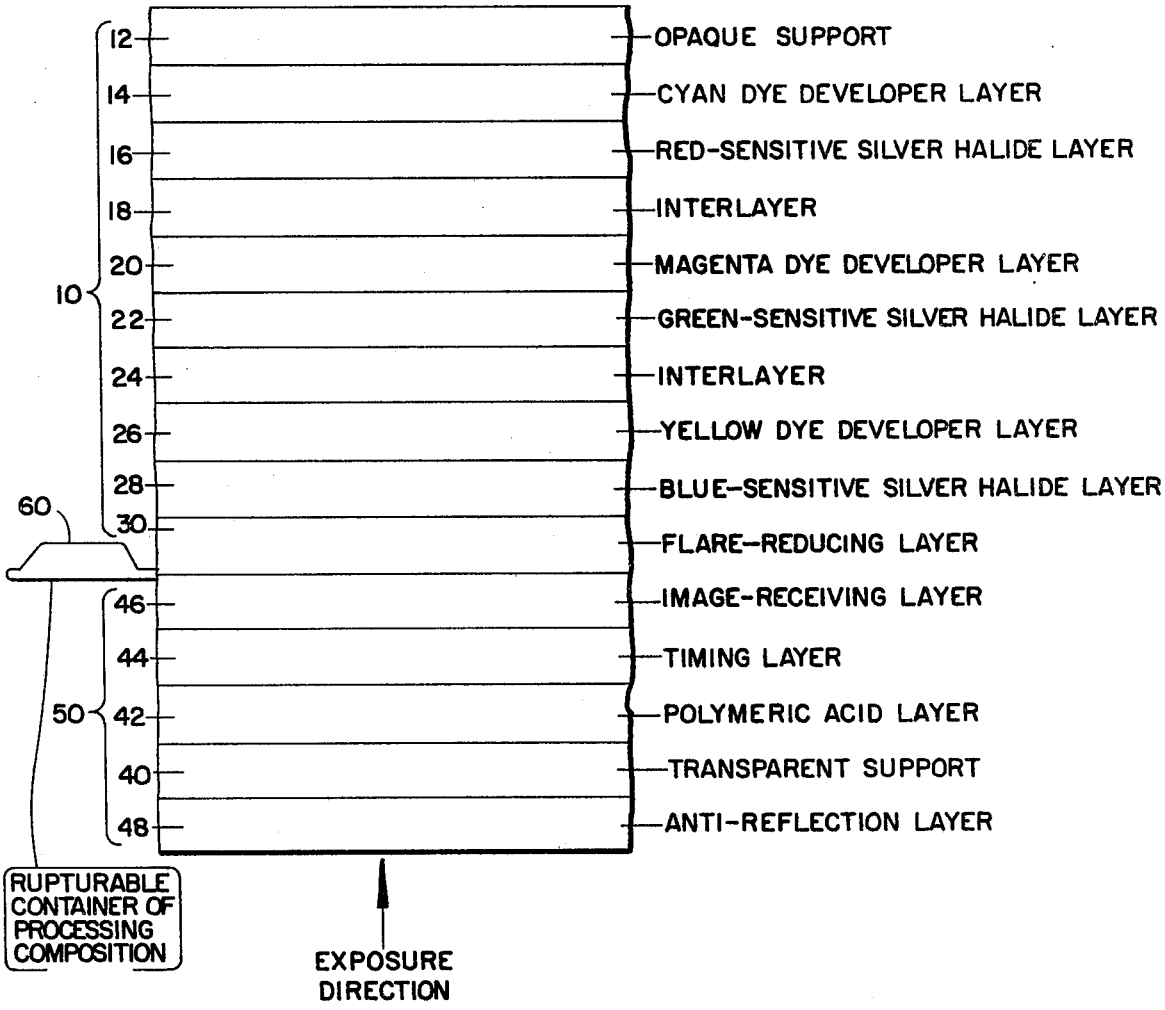
12
14
16
18
20
10
22
24
26
28
30
60
46
44
50
42
40
48
OPAQUE SUPPORT
CYAN DYE DEVELOPER LAYER
RED-SENSITIVE SILVER HALIDE LAYER
INTERLAYER
MAGENTA DYE DEVELOPER LAYER
GREEN-SENSITIVE SILVER HALIDE LAYER
INTERLAYER
YELLOW DYE DEVELOPER LAYER
BLUE-SENSITIVE SILVER HALIDE LAYER
FLARE-REDUCING LAYER
IMAGE-RECEIVING LAYER
TIMING LAYER
POLYMERIC ACID LAYER
TRANSPARENT SUPPORT
ANTI-REFLECTION LAYER
RUPTURABLE CONTAINER OF PROCESSING COMPOSITION
EXPOSURE DIRECTION

DIFFUSION TRANSFER INTEGRAL FILM UNITS WITH FLARE REDUCING LAYERS

This is a continuation of application Ser. No. 554,741, filed Mar. 3, 1975, now abandoned.

This application relates to photography and, more particularly, to diffusion transfer photography and film units for use therein.

A number of diffusion transfer photographic processes have been proposed wherein the resulting photograph comprises the developed silver halide emulsions retained with the dyeimage carrying layer as part of a permanent laminate. The image-carrying layer is separated from the developed silver halide emulsions in said laminate by a light-reflecting layer, preferably a layer containing titanium dioxide. Illustrative of patents describing such products and processes are U.S. Pat. No. 2,983,606 issued Mar. 9, 1961 to Howard G. Rogers, U.S. Pat. Nos. 3,415,644, 3,415,645 and 3,415,646 issued Dec. 10, 1968 to Edwin H. Land, U.S. Pat. Nos. 3,594,164 and 3,594,165 issued July 20, 1971 to Howard G. Rogers, U.S. Pat. No. 3,647,437 issued Mar. 7, 1972 to Edwin H. Land and U.S. Pat. No. 3,793,022 issued Feb. 19, 1974 to Edwin H. Land.

Referring more specifically to the aforementioned U.S. Pat. No. 3,415,644, said patent discloses photographic products and processes employing dye developers wherein a photosensitive element and an image-receiving layer are maintained in fixed relationship prior to photoexposure and this fixed relationship is maintained after processing and image formation to provide a laminate including the processed silver halide emulsions and the image-receiving layer. Photoexposure is made through a transparent (support) element and application of a processing composition provides a layer of light-reflecting material to provide a white background for viewing the image and to mask the developed silver halide emulsions. The desired color transfer image is viewed through said transparent support against said white background.

While film units of the foregoing type basically comprise two separate sheet-like elements, a number of advantages can be realized by laminating the two elements during the manufacture and assembly process and delaminating the elements following exposure by and in response to spreading of the processing liquid. For example, a prelaminated integral film unit is easier to handle and manipulate during assembly and during exposure and processing within the camera; it is more compact and hence, permits smaller and less bulky film packs and cameras; and it is less subject to buckling and distortion due to temperature and humidity changes and more likely to lie flat and remain planar during exposure. Since the elements are in contact throughout the entire extent of their facing surface, every portion of each element is exposed to substantially the same ambient conditions so that each portion has the same physical and chemical properties as every other portion and the elements produce uniform results. The photographically active layers of the film unit are not only protected against mechanical damage, but are additionally protected against changes in ambient conditions which may also affect their function. Moreover, processing, specifically, spreading of the processing liquid within the film unit, is facilitated since there is little or substantially no air between the sheets to interfere with liquid distribution.

Methods of laminating said elements have been described in U.S. Pat. No. 3,652,281 to Albert J. Bachelder and Frederick C. Binda and U.S. Pat. No. 3,652,282 to Edwin H. Land, both issued Mar. 28, 1972. A particularly useful and preferred laminating process utilizes a water-soluble polyethylene glycol and is described and claimed in U.S. Pat. No. 3,793,023 issued Feb. 19, 1974 to Edwin H. Land.

The present invention is concerned with providing diffusion transfer film units having improved properties.

A primary object of this invention is to provide diffusion transfer film units adapted to produce integral negative-positive reflection prints exhibiting reduced image flare.

A further object of this invention is to provide diffusion transfer film units providing images exhibiting increased image acutance.

Still another object of this invention is to provide diffusion transfer film units including a flare-reducing layer, adjacent or contiguous the photosensitive layer(s), positioned in the exposure path and adapted to absorb light forwardly reflected from the photosensitive layer(s).

Other objects of the invention will in part be obvious and will in part appear hereinafter.

The invention accordingly comprises the product possessing the features, properties and relation of components and the process involving the several steps and the relation and order of one or more of such steps with respect to each of the others which are exemplified in the following detailed disclosure, and the scope of the application of which will be indicated in the claims.

For a fuller understanding of the nature and objects of the invention, reference should be had to the following detailed description taken in conjunction with the accompanying drawing wherein:

The FIG. is a diagrammatic, enlarged cross-sectional view of a diffusion transfer film unit embodying the present invention.

As noted above, this invention is particularly concerned with diffusion transfer processes wherein the layer containing the diffusion transfer image, i.e., the image-receiving layer, is not separated from the developed photosensitive layers after processing but both components are retained together as part of a permanent laminate. Film units particularly adapted to provide such diffusion transfer images have frequently been referred to as "integral negative-positive" film units. The resulting image may be referred to as an "integral negative-positive reflection print" and as so used this expression is intended to refer to a reflection print wherein the developed photosensitive layers have not been separated from the image layer, i.e., the layer containing the transfer image. A light-reflecting layer between the developed photosensitive layer(s) and the image layer provides a white background for the transfer image and masks the developed photosensitive layer(s). These layers are part of a permanent laminate which usually includes dimensionally stable outer or support layers, the transfer image being viewable through one of said supports.

The present invention is applicable to a wide variety of diffusion transfer processes. The arrangement and order of the individual layers of the film used in such processes may vary in many ways as is known in the art, provided the final reflection print is a laminate wherein the desired image is viewed through a transparent support, e.g., an integral negative-positive reflection print as described above. For convenience, however, the more specific descriptions of the invention hereinafter set forth will be by use of dye developer diffusion transfer color processes and of integral negative-positive film units of the type contemplated in the previously mentioned patents, particularly U.S. Pat. Nos. 3,415,644 and 3,594,164. It will be readily apparent from such descriptions that other image-forming reagents may be used, e.g., color couplers, coupling dyes or dyes (couplers) which release a dye or dye intermediate as a result of coupling or oxidation.

As noted above, a particularly useful diffusion transfer film unit is one in which the two sheet-like elements are laminated to each other prior to exposure. In such a laminate there is no air space between the layers thereof, and exposure of the photosensitive layer(s) is effected through a transparent support layer. Application of the processing composition is effective to delaminate this laminate and to form a new laminate comprising the desired integral negative-positive reflection print. One such film has been commercialized as Polaroid SX-70 Land film.

It has now been discovered that such integral negative-positive reflection prints may be improved by providing a flare-reducing layer, within the film unit, in the exposure path and adjacent the photosensitive silver halide layer(s). While this flare-reducing layer is initially in the exposure path, it is hidden from view in the final integral negative-positive reflection print.

The flare-reducing layer provided in accordance with this invention acts to absorb light reflected forwardly from the photosensitive layer during photoexposure, thereby preventing such light from being again reflected back to the photosensitive layer as a function of the difference in the respective indices of refraction of the photosensitive layer and another layer, e.g., the transparent support, through which photoexposure has been effected. Most of the light re-reflected from the transparent support back toward the photosensitive layer(s) will strike the photosensitive layer(s) laterally displaced relative to the point from which it was reflected by the photosensitive layer. The amount of light reflected from any given point on the photosensitive layer will be a function of the intensity of the light incident thereon from the photographed subject. Where the light intensity is very high relative to other portions of the subject, reflected light re-reflected laterally creates flare and reduces image acutance or apparent sharpness. Thus, if a black object were placed on a white background and photographed from a short distance using a flash bulb, the density of the black object near the edges thereof would be reduced by the light re-reflected laterally. The edge portions of the object would be lighter in density and less sharp; in extreme situations, the density of the black object would be reduced to such an extent that it would appear "washed out." The present invention controls this problem by absorbing such reflected light before it can cause "flare" exposure. In certain high intensity exposure situations, the effect of the flare-reducing layer frequently is to reduce the likelihood of localized overexposure of a portion of a scene, in effect thereby providing an increase in the exposure latitude of the film. Thus, contrast is better retained within bright portions of the scene.

The invention may be better understood at this point by referring to the accompanying drawing wherein the FIGURE illustrates a prelaminated film unit embodying the present invention, and shown prior to photoexposure. This film unit comprises a laminate of a photosensitive or negative component 10 and a positive or image-receiving component 50. The photosensitive component 10 comprises an opaque support 12 carrying, in sequence, a cyan dye developer layer 14, a red-sensitive silver halide emulsion layer 16, an interlayer 18, a magenta dye developer layer 20, a green-sensitive silver halide emulsion layer 22, an interlayer 24, a yellow dye developer layer 26, a blue-sensitive silver halide emulsion layer 28 and a flare-reducing layer 30 containing a light-absorbing material such as carbon black. The positive component 50 comprises a transparent support 40 carrying, in sequence, a polymeric acid layer 42, a timing layer 44 and an image-receiving layer 46. The photosensitive component 10 and the positive component 40 are laminated together with their supports 12 and 40 outermost. (Where this prelamination is effected using a solution of a polymer, such as polyethylene glycol as described above, a separate stratum of such polymer may be present; for convenience, such a stratum has not been shown.) Photoexposure is effected through the positive component 50. A rupturable container 60 is so positioned that, upon rupture, the processing composition contained therein will be forced between the light-absorbing layer 30 of the photosensitive component 10 and the image-receiving layer 46 of the positive component 50. The processing composition includes a light-reflecting agent such as titanium dioxide, and solidification of the thus-applied layer of processing composition will provide a white, light-reflecting layer masking the flare-reducing layer 30 and the developed photosensitive component from view and providing a background against which the multicolor diffusion transfer image formed in the image-receiving layer 46 may be viewed through the transparent support 40.

In the illustrated embodiment, the positive component 50 includes an anti-reflection coating or layer 48. While such an anti-reflection coating is not an essential part of the present invention, it is present in the preferred embodiments thereof.

Referring again to the FIGURE, it will be seen that photoexposure is effected through the transparent support 40. A portion of the exposing light which passes through the transparent support 40, the polymeric acid layer 42, the timing layer 44 and the image-receiving layer 46 will be reflected, i.e., reflected forwardly or back towards the transparent support 40, from the silver halide grains in the silver halide emulsion layer 28. Absent the flare-reducing layer 30, this reflected light would be re-reflected back towards the silver halide emulsion layer from the inner surface of the transparent support 40 due to its higher index of refraction compared with that of the gelatin of the silver halide emulsion or of the other intermediate layers. (This discussion assumes intermediate layers have an index of refraction substantially the same or lower than that of gelatin; if there is an intervening change from low to high index in the path of reflected light before the transparent support, re-reflection would occur at the intervening high index layer.) At least a fraction of the light reflected from the silver halide emulsion at an angle (other than normal) will be re-reflected from the interface with the higher index transparent support, and the thus re-reflected light will strike the silver halide emulsion at a point displaced laterally with respect to the initial reflection point. If an object within the photographed scene is very bright, such as a bare fluoroescent or incandescent light, the additional and displaced exposure resulting from such internal reflection introduces flare, reducing the acutance with which the object is reproduced. If a relatively dark object is positioned against a highly reflective area, e.g., a black handle on a white refrigerator in a flash exposure or poles standing in snow or in a body of water under a strong sun, the resulting flare will cause the edges of the dark object to be much less sharp and the dark object itself, if relatively small or narrow, may be reproduced with an undesirable high loss of density. Experiments have shown that the presence of the flare-reducing layer 30 as shown in the FIGURE dramatically reduces such "internal" flare; images taken under conditions such as just described show the "dark" objects reproduced with sharper edges and greater density or saturation than if the flare-reducing layer was not present.

The light-absorbing material utilized to provide the flare-reducing layer 30 may be any light-absorbing material which does not introduce photographically undesirable substances, e.g., substances which would adversely affect the sensitometric properties of the photosensitive layer(s) or the stability or aesthetic properties of the transfer image. A particularly useful light-absorbing material is carbon black which is a good light absorber over the whole visible light range and which itself also does not reflect light. As will be readily apparent, the light-absorbing material should be non-diffusing, either before or after photoexposure and processing, lest undesirable color or density be added to the white or "highlight" areas of the transfer image. While it is within the scope of this invention to employ a mixture of dyes or pigments of different colors, such an embodiment is less preferred than a single neutral colored pigment, and care should be taken in selecting the individual dyes or pigments to insure that they do not absorb one color and reflect another which will not be absorbed by the other dyes or pigments.

The density, i.e., transmission density, of the flare-reducing layer may vary over a wide range and the density most effective for a particular film may be readily determined by routine experimentation. By way of illustration, it has been found that a layer of gelatin containing about 5 mgs./ft.$^2$ of carbon black and having a transmission density of approximately 0.2, was highly effective as a flare-reducing layer when used in an integral negative-positive film having an equivalent ASA exposure index of approximately 110–120. In general, the transmission density of the flare-reducing layer need not be in excess of about 0.3, and preferably will be within the range of about 0.1 to about 0.3, and more preferably within the range of about 0.15 to about 0.2. In the event that the transmission density of the flare-reducing layer is so great as to significantly reduce the exposure index of the film relative to its exposure index without the flare-reducing layer, one may substitute silver halide emulsions of sufficiently higher sensitivity so that the final film has the desired exposure index.

The flare-reducing layer is positioned adjacent, and preferably contiguous with, the photosensitive layer, and is carried by the same support. If several photosensitive layers are present, as in a multicolor film, the flare-reducing layer will be positioned adjacent or contiguous the top photosensitive layer, i.e., the photosensitive layer first exposed (usually the blue-sensitive silver halide layer). It will be apparent that the flare-reducing layer will be positioned between the photosensitive layer and the applied processing composition, and it therefore should be permeable to the processing composition.

It will be understood that the flare-reducing layer may also contain other agents useful in performing the diffusion transfer process, e.g., auxiliary developing agents, antifoggants, development restrainers, etc. The binder or matrix material for the flare-reducing layer should have an index of refraction substantially the same as that of the photosensitive layer. Accordingly, gelatin is a preferred binder.

An anti-reflection coating is highly effective in controlling (reducing) flare resulting from light which, absent the anti-reflection coating, would be reflected from the external surface of the transparent support (through which photoexposure is made) and bounce within the camera. The flare-reducing layer provided in accordance with this invention reduces "internal" flare, i.e., flare resulting from light reflected within the film unit. The use of this flare-reducing layer in combination with such an anti-reflection coating is thus highly advantageous, and use of such a combination significantly increases acutance or apparent sharpness of the final integral negative-positive reflection print.

The illustrated embodiment includes appropriate means of opacification to permit the processing of the film unit outside of a dark chamber, i.e., the film unit is intended to be removed from the camera prior to image completion and while the film is still photosensitive. Opacifying systems are described in the previously noted patents and per se form no part of the present invention which is equally applicable to film units intended to be processed within a dark chamber.

A particularly useful opacifying system for film units of the type shown in the FIGURE utilizes a color dischargeable reagent, preferably a pH-sensitive optical filter agent or dye, sometimes referred to as an indicator dye, as is described in detail in the aforementioned U.S. Pat. No. 3,647,437. In film units of the type shown and described in the aforementioned U.S. Pat. Nos. 3,594,164 and 3,594,165, photoexposure is effected from the side opposite the side from which the image is viewed. An opaque layer to protect the exposed silver halide from further exposure may be provided by including a light-absorbing opacifying agent, e.g., carbon black, in the processing composition which is distributed between the photosensitive layer(s) and a transparent support or spreader sheet. In such film units, it may be desirable to include a preformed opaque layer, e.g., a dispersion of carbon black in a polymer permeable to the processing composition, between a preformed light-reflecting layer and the silver halide emulsion(s).

The optical filter agent is retained within the final film unit laminate and is preferably colorless in its final form, i.e., exhibiting no visible absorption to degrade the transfer image or the white background therefor provided by the reflecting layer. The optical filter agent may be retained in the reflecting layer under these conditions, and it may contain a suitable "anchor" or "ballast" group to prevent its diffusion into adjacent layers. Alternatively, if the optical filter agent is initially diffusible, it may be selectively immobilized on the silver halide emulsion side of the reflecting layer, e.g., by a mordant coated on the surface of the silver halide emulsion layer; in this embodiment the optical filter in its final state may be colorless or colored so long as any color exhibited by it is effectively masked by the reflecting layer.

The reflecting layer provided in the embodiment of this invention shown in the FIGURE is formed by solidification of a stratum of pigmented processing composition distributed after exposure. It is also within the scope of this invention to provide a preformed white pigment layer, e.g., a layer of titanium dioxide coated over the image-receiving layer 46, and to effect photoexposure therethrough, in accordance with the teachings of U.S. Pat. No. 3,615,421 issued Oct. 26, 1971 to Edwin H. Land.

In the illustrated embodiment, photoexposure and viewing of the final image both are effected through the transparent support 40. Accordingly, the advantages of the anti-reflection coating 48 are obtained twice, i.e., first, by minimizing failure of the film unit to record light passed by the camera lens and second, by minimizing glare during viewing.

It will be recognized that the transfer image formed following exposure and processing of film units of the type illustrated in the FIGURE will be a geometrically reversed image of the subject. Accordingly, to provide geometrically nonreversed transfer images, exposure of such film units should be accomplished through an image reversing optical system, such as in a camera possessing an image reversing optical system utilizing mirror optics, e.g., as described in U.S. Pat. No. 3,447,437 issued June 3, 1969 to Douglas B. Tiffany.

If desired, the photosensitive element 10 may utilize a transparent support instead of the opaque support 12 shown in the FIGURE. In this alternative embodiment, the film unit should be processed in a dark chamber or an opaque layer, e.g., pressure-sensitive, should be superposed over said transparent support to avoid further exposure through the back of the film unit if processing is effected outside of the camera.

Processing of film units of the several types described above is initiated by distributing the processing composition between predetermined layers of the film unit. In exposed and developed areas, the dye developer will be immobilized as a function of development. In unexposed and undeveloped areas, the dye developer is unreacted and diffusible, and this provides an imagewise distribution of unoxidized dye developer, diffusible in the processing composition, as a function of the point-to-point degree of exposure of the silver halide layer. The desired transfer image is obtained by the diffusion transfer to the image-receiving layer of at least part of this imagewise distribution of unoxidized dye developer. In the illustrated embodiments, the pH of the photographic system is controlled and reduced by the neutralization of alkali after a predetermined interval, in accordance with the teachings of the above-noted U.S. Pat. No. 3,615,644, to reduce the alkalinity to a pH at which the unoxidized dye developer is substantially insoluble and non-diffusible. As will be readily recognized, the details of such processes form no part of the present invention but are well known; the previously noted U.S. patents may be referred to for more specific details of such processes.

Multicolor images may be obtained by providing the requisite number of differentially exposable silver halide emulsions, and said silver halide emulsions are most commonly provided as individual layers coated in superposed relationship. Film units intended to provide multicolor images comprise two or more selectively sensitized silver halide layers each having associated therewith an appropriate image dye-providing material providing an image dye having spectral absorption characteristics substantially complementary to the light by which the associated silver halide is exposed. The most commonly employed negative components for forming multicolor images are of the "tripack" structure and contain blue-, green- and red-sensitive silver halide layers each having associated therewith in the same or in a contiguous layer a yellow, a magenta and a cyan image dye-providing material respectively. Interlayers or spacer layers may, if desired, be provided between the respective silver halide layers and associated image dye-providing materials or between other layers. Integral multicolor photosensitive elements of this general type are disclosed in U.S. Pat. No. 3,345,163 issued Oct. 3, 1967 to Edwin H. Land and Howard G. Rogers as well as in the previously noted U.S. patents.

A number of modifications to the structure described in connection with the FIGURE will readily suggest themselves to one skilled in the art. Thus, for example, the multicolor multilayer negative may be replaced by a screen-type negative as illustrated in U.S. Pat. No. 2,968,554 issued Jan. 17, 1961 to Edwin H. Land and in the aforementioned U.S. Pat. No. 2,983,606 particularly with respect to FIG. 9 thereof.

The image dye-providing materials which may be employed in such processes generally may be characterized as either (1) initially soluble or diffusible in the processing composition but are selectively rendered non-diffusible in an imagewise pattern as a function of development; or (2) initially insoluble or non-diffusible in the processing composition but which are selectively rendered diffusible or provide a diffusible product in an imagewise pattern as a function of development. These material may be complete dyes or dye intermediates, e.g., color couplers. The requisite differential in mobility or solubility may, for example, be obtained by a chemical action such as a redox reaction or a coupling reaction.

As examples of initially soluble or diffusible materials and their application in color diffusion transfer, mention may be made of those disclosed, for example, in U.S. Pat. Nos. 2,774,668; 2,968,554; 2,983,606; 2,087,817; 3,185,567; 3,230,082; 3,345,163; and 3,443,943. As examples of initially non-diffusible materials and their use in color transfer systems, mention may be made of the materials and systems disclosed in U.S. Pat. Nos. 3,185,567; 3,443,939; 3,443,940; 3,227,550; 3,227,552; and 3,719,489. Both types of image dye-providing substances and film units useful therewith also are discussed in the aforementioned U.S. Pat. No. 3,647,437 to which reference may be made.

It will be understood that dye transfer images which are neutral or black-and-white instead of monochrome or multicolor may be obtained by use of a single dye or a mixture of dyes of the appropriate colors in proper proportions, the transfer of which may be controlled by a single layer of silver halide, in accordance with known techniques. It is also to be understood that "direct positive" silver halide emulsions may also be used, depending upon the particular image dye-providing substances employed and whether a positive or negative color transfer image is desired.

It will also be undertood that the present invention may be utilized with films wherein the final image is in silver, and photoexposure and/or viewing is effected through a transparent support which may be provided with an anti-reflection coating in accordance with the teachings of this disclosure. The transfer of silver may be utilized to provide a silver image or to provide a dye image by silver dye bleach processing. Where a transfer image in silver is to be formed, the image-receiving layer will include a silver precipitating agent and processing will be effected using a silver halide solvent, as is well known in the art.

In the preferred embodiments, the layers comprising the individual film units are secured in fixed relationship prior to, during, and after photoexposure and processing to provide the desired integral negative-positive image. Film units of this type are well known in the art and are illustrated, for example, in the above cited U.S. Pat. Nos. 3,415,644; 3,647,437; and 3,594,165, as well as in other patents. In general, a binding member is provided extending around, for example, the edges of the composite structure and securing the elements thereof in fixed relationship. The binding member may comprise a pressure-sensitive tape securing and/or maintaining the layers of the structure together at its respective edges. If the edge tapes are also opaque, edge leakage of actinic radiation incident on the film unit will be prevented. The edge tapes also will act to prevent leakage of the processing composition from the laminate during and after processing. The rupturable pod is so positioned as to discharge its contents between predetermined layers; e.g., between the image-receiving layer 46 and the flare-reducing layer 30 of the FIGURE; these layers are temporarily bonded to each other with a bond strength less than that exhibited by the interface between the opposed surfaces of the remaining layers, as described above. The binding member may also serve to provide a white mask or border for the final image. The manufacture of such film units or packets is well described in the above-noted and other patents and need not be set forth in any detail here.

Rupturable container 60 may be of the type shown and described in any of U.S. Pat. Nos. 2,543,181; 2,634,886; 3,653,732; 2,723,051; 3,056,492; 3,056,491; 3,152,515; and the like. In general, such containers will comprise a rectangular blank of fluid- and air-impervious sheet material folded longitudinally upon itself to form two walls which are sealed to one another along their longitudinal and end margins to form a cavity in which processing composition is retained. The longitudinal marginal seal is made weaker than the end seals so as to become unsealed in response to the hydraulic pressure generated within the fluid contents of the container by the application of compressive pressure to the walls of the container, e.g., by passing the film unit between opposed pressure applying rollers.

The rupturable container 60 is so positioned as to effect unidirectional discharge of the processing composition between predetermined layers upon application of compressive force to the rupturable container. Thus, the rupturable container 60, as illustrated in the FIGURE, is fixedly positioned and extends transverse a leading edge of the prelaminated film unit with its longitudinal marginal seal directed toward the interface between the image-receiving layer 46 and the flare-reducing layer 30.

A preferred opacification system to be contained in the processing composition to effect processing outside of a camera is that described in the above-mentioned U.S. Pat. No. 3,647,437, and comprises a dispersion of an inorganic light-reflecting pigment which also contains at least one light-absorbing agent, i.e., optical filter agent, at a pH above the pKa of the optical filter agent in a concentration effective when the processing composition is applied, to provide a layer exhibiting optical transmission density > than about 6.0 density units with respect to incident radiation actinic to the photosensitive silver halide and optical reflection density < than about 1.0 density units with respect to incident visible radiation.

In lieu of having the light-reflecting pigment in the processing composition, the light-reflecting pigment used to mask the photosensitive strata and the flare-reducing layer, and to provide the background for viewing the color transfer image formed in the receiving layer, may be present initially in whole or in part as a preformed layer in the film unit. As an example of such a preformed layer, mention may be made of that disclosed in U.S. Pat. No. 3,615,421 issued Oct. 26, 1971 and in U.S. Pat. No. 3,620,724 issued Nov. 16, 1971, both in the name of Edwin H. Land. The reflecting agent may be generated in situ as is disclosed in U.S. Pat. Nos. 3,647,434 and 3,647,435, both issued Mar. 7, 1971 to Edwin H. Land.

The dye developers (or other image dye-providing substances) are preferably selected for their ability to provide colors that are useful in carrying out subtractive color photography, that is, the previously mentioned cyan, magenta and yellow. They may be incorporated in the respective silver halide emulsion or, in the preferred embodiment, in a separate layer behind the respective silver halide emulsion. Thus a dye developer may, for example, be in a coating or layer behind the respective silver halide emulsion and such a layer of dye developer may be applied by use of a coating solution containing the respective dye developer distributed, in a concentration calculated to give the desired coverage of dye developer per unit area, in a film-forming natural, or synthetic, polymer, for example, gelatin, polyvinyl alcohol, and the like, adapted to be permeated by the processing composition.

Dye developers, as noted above, are compounds which contain the chromophoric system of a dye and also a silver halide developing function. By "a silver halide developing function" is meant a grouping adapted to develop exposed silver halide. A preferred silver halide development function is a hydroquinonyl group. Other suitable developing functions include ortho-dihydroxyphenol and ortho- and para-amino substituted hydroxyphenyl groups. In general, the development function includes a benzenoid developing function, that is, an aromatic developing group which forms quinonoid or quinone substances when oxidized.

The image-receiving layer may comprise one of the materials known in the art, such as polyvinyl alcohol, gelatin, etc. It may contain agents adapted to mordant or otherwise fix the transferred images dyes(s). Preferred materials comprise polyvinyl alcohol or gelatin containing a dye mordant such as poly-4-vinylpyridine, as disclosed in U.S. Pat. No. 3,148,061, issued Sept. 8, 1964 to Howard C. Haas.

In the various color diffusion transfer systems which have previously been described, and which employ an aqueous alkaline processing fluid, it is well known to employ an acid-reacting reagent in a layer of the film unit to lower the environmental pH following substantial dye transfer in order to increase the image stability and/or to adjust the pH from the first pH at which the image dyes are diffusible to a second (lower) pH at which they are not. For example, the previously mentioned U.S. Pat. No. 3,415,644 discloses systems wherein the desired pH reduction may be effected by providing a polymeric acid layer adjacent the dyeable stratum. These polymeric acids may be polymers which contain acid groups, e.g., carboxylic acid and sulfonic acid groups, which are capable of forming salts with alkali metals or with organic bases; or potentially acid-yielding groups such as anhydrides or lactones. Preferably the acid polymer contains free carboxyl groups. Alternatively, the acid-reacting reagent may be in a layer adjacent to the silver halide most distant from the image-receiving layer, as disclosed in U.S. Pat. No. 3,573,043 issued Mar. 30, 1971 to Edwin H. Land. Another system for providing an acid-reacting reagent is disclosed in U.S. Pat. No. 3,576,625 issued Apr. 27, 1971 to Edwin H. Land.

An inert interlayer or spacer layer may be and is preferably disposed between the polymeric acid layer and the dyeable stratum in order to control or "time" the pH reduction so that it is not premature and interferes with the development process. Suitable spacer or "timing" layers for this purpose are described with particularity in U.S. Pat. Nos. 3,362,819; 3,419,389; 3,421,893; 3,455,686; and 3,575,701.

While the acid layer and associated spacer layer are preferably contained in the positive component, between the transparent support for the image-receiving layer and the image-receiving stratum, they may, if desired, be associated with the photosensitive strata, as is disclosed, for example, in U.S. Pat. Nos. 3,362,821 and 3,573,043 or they may be present in both components. In film units such as those described in the aforementioned U.S. Pat. Nos. 3,594,164 and 3,594,165, they also may be contained on the spreader sheet employed to facilitate application of the processing fluid.

As is now well known and illustrated, for example, in the previously cited patents, the liquid processing composition referred to for effecting multicolor diffusion transfer processes comprises at least an aqueous solution of an alkaline material, for example sodium hydroxide, potassium hydroxide, and the like, and preferably possessing a pH in excess of 12, and most preferably includes a viscosity-increasing compound constituting a film-forming material of the type which, when the composition is spread and dried, forms a relatively firm and relatively stable film. The preferred film-forming materials comprise high molecular weight polymers such as polymeric, water-soluble ethers which are inert to an alkaline solution such as, for example, a hydroxyethyl cellulose or sodium carboxymethyl cellulose. Other known film-forming materials or thickening agents whose ability to increase viscosity is substantially unaffected if left in aqueous alkaline solution for a long period of time also may be employed. As stated, the film-forming material is preferably contained in the processing composition in such suitable quantities as to impart to the composition a viscosity in excess of 100 cps, at a temperature of approximately 24° C. and preferably in the order of 100,000 cps to 200,000 cps at that temperature.

In particularly useful embodiments of this invention, the transparent support through which photoexposure is made contains a small quantity of a pigment, e.g., carbon black, to prevent fog formation due to light-piping by internal reflection within the transparent support of actinic light incident upon an edge thereof; such elements are described and claimed in the copending application of Edwin H. Land, Ser. No. 419,808, filed Nov. 28, 1973, now abandoned. Similarly, fog from such light-piping may be avoided by incorporating an alkali-dischargeable dye in a suitable layer, e.g., the image-receiving layer, in accordance with the disclosure of the copending application of Howard G. Rogers, Ser. No. 408,052, filed Oct. 19, 1973, now abandoned.

This invention will be further illustrated by the following examples:

EXAMPLE 1

A multicolor photosensitive element using, as the cyan, magenta and yellow dye developers

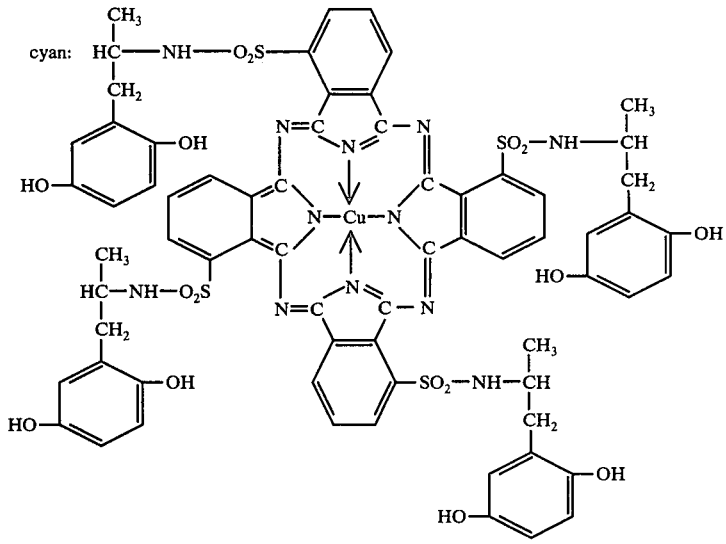

-continued magenta:

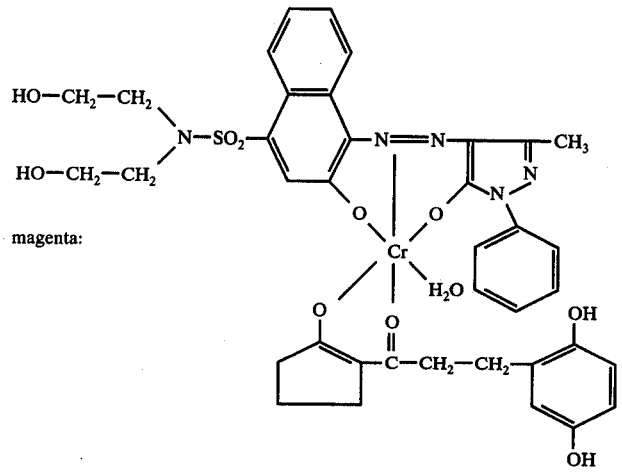

yellow:

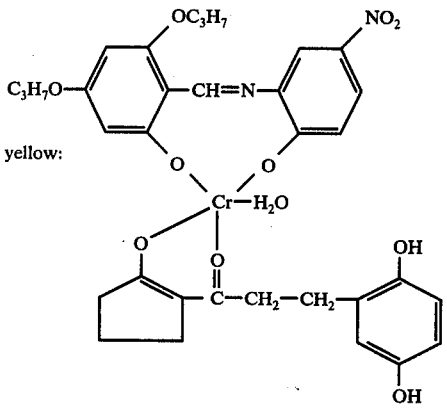

was prepared by coating a gelatin-subcoated 4 mil opaque polyethylene terephthalate film base with the following layers:

1. a layer of cyan dye developer dispersed in gelatin;
2. a red-sensitive gelatino silver halide emulsion;
3. a layer of 60-30-4-6 copolymer of butylacrylate, diacetone acrylamide, styrene and methacrylic acid, and polyacrylamide;
4. a layer of magenta dye developer dispersed in gelatin;
5. a green-sensitive gelatino silver halide emulsion;
6. a layer containing the copolymer referred to above in layer 3 and polyacrylamide;
7. a layer of yellow dye developer dispersed in gelatin;
8. a blue-sensitive gelatino silver halide emulsion layer;
9. a flare-reducing layer comprising carbon black dispersed in gelatin and coated to provide a coverage of about 29 mg./ft.$^2$ of gelatin and about 4.8 mg./ft.$^2$ of carbon black.

A sub-coated transparent 4 mil polyethylene terephthalate film base (containing a small, anti-light-piping quantity of carbon black and having a transmission density of about 0.05) was coated, in succession, with the following layers to form an image-receiving component:

1. as a polymeric acid layer, a partial butyl ester of a polyethylene/maleic anhydride copolymer;
2. a timing layer containing about a 40:1 ratio of a 60-30-4-6 copolymer of butylacrylate, diacetone acrylamide, styrene and methacrylic acid, and polyacrylamide;
3. a polymeric image-receiving layer containing a 2:1 mixture, by weight, of polyvinyl alcohol and poly-4-vinylpyridine. The other side of the transparent polyethylene terephthalate was coated with a mixture of a vinylidene fluoride/tetrafluoroethylene copolymer, polymethacrylate, and a copolymer of chlorotrifluoroethylene and vinylidene fluoride (as described in the copending application of Charles K. Chiklis, Ser. No. 354,008, filed Apr. 24, 1973, now U.S. Pat. No. 3,925,081 issued Dec. 9, 1975) to provide an anti-reflection coating.

The two components thus prepared were then laminated together using as the laminating fluid an aqueous solution of polyethylene glycol having an average molecular weight of approximately 6,000 ("Carbowax 6,000," trade name of Union Carbide Corporation) distributed between the flare-reducing layer and the image-receiving layer. Individual integral film units, similar to SX-70 film units, were prepared using sections of said laminate with a rupturable container retaining an aqueous alkaline processing solution attached, by pressure-sensitive tape, so that, upon application of compressive pressure to the container to rupture the container's marginal seal, its contents would be distributed between the image-receiving layer and the flare-reducing layer of the photosensitive component.

A second set of integral film units was prepared in like manner except that the flare-reducing layer 9 was replaced by an identical gelatin layer which did not contain a light-absorbing material.

The integral film units were exposed, through the transparent polyethylene terephthalate support, by ambient light, in a Polaroid SX-70 Land camera, to high contrast scenes such as a fluoroescent light fixture over a set of metal light baffles (but no light diffusing cover) and a boat marina with a large area of water under a bright sun. Examination of the resulting multicolor integral negative-positive reflection prints showed marked reductions in image flare in the integral negative-positive reflection prints formed in the integral film units containing the flare-reducing layer, as illustrated by sharper edges of objects silhouetted against bright areas of the scene. Thus, for example, when the described fluorescent light fixture was photographed close up, the edges of the light baffles were well defined when the flare-reducing layer was present but were reproduced narrower in width and with unsharp, uneven edges in the absence of the flare-reducing layer.

(In the above example, the processing composition contained titanium dioxide and optical filter agents to provide an opacification system, as described in the above-mentioned U.S. Pat. No. 3,647,437, so that the film units could be developed in ambient light. Specific coverages and concentrations of the various processing components, as well as the composition of the processing composition, have not been recited, since they are unnecessary to either understanding or practicing the invention. It will be noted, however, that representative reagents and concentrations are described in the various U.S. patents to which cross-reference has been made in this application).

The flare-reducing layer was prepared as follows: An aqueous carbon black dispersion (25% by weight carbon black) was prepared by ball milling "Molacco H" carbon black (a furnace black sold by Columbian Carbon Co.) in water containing 5% by weight of the carbon black of Tamol 731 (an anionic dispersing agent sold by Rohm & Haas Co. and described as a sodium salt of a polymeric carboxylic acid). The carbon dispersion was added slowly to an aqueous gelatin solution containing 0.54%, by volume, of Alkanol B (sodium alkylnaphthalene sulfonate anionic wetting agent sold by E. I. du Pont de Nemours & Co.) and 0.054%, by volume, of Aerosol OT (dioctyl ester of sodium sulfosuccinic acid anionic wetting agent sold by American Cyanamid Co.), and the resulting mixture was stirred for about 30 minutes. Polyvinyl hydrogen phthalate (2.3% by weight of gelatin) was added to obtain the desired coating viscosity, and the resulting dispersion was used to coat the flare-reducing layer recited in Example 1.

The flare-reducing layer was found to reduce the equivalent ASA exposure index by about 0.2 log E units, indicating that it had a transmission density of approximately 0.2.

EXAMPLE 2

Integral film units similar to those described in Example 1 were prepared without prelaminating the photosensitive and image-receiving components, i.e., an air layer was present between these components during photoexposure. These film units were contact printed against a transparent resolution chart using a sensitometer having a point source of light. Examination of the resulting integral negative-positive reflection prints showed a reduction in flare and an increase in acutance if the flare-reducing layer was present. (It will be noted that internal flare is less of a problem where an air layer is present, since the solid angle over which light will be re-reflected from the air/polymer interface is much less than where there is no air space between the components. Further, the index of refraction of the transparent support is less significant in causing internal flare where there is an intervening air/polymer interface within the film unit.) When prelaminated integral film units were contact printed in the same manner, the amount of internal flare was greater in the film units which did not contain the flare-reducing layer. Those prelaminated integral film units which contained the flare-reducing layer showed a great reduction in internal image flare with substantially increased image acutance.

EXAMPLE 3

Integral film units similar to those described in Example 1 were prepared wherein the flare-reducing layer contained approximately 3 mg./ft.$^2$ of carbon black (Molacco H). (This flare-reducing layer had a transmission density of approximately 0.15.) Tests demonstrated that a substantial reduction in internal flare was effected by the flare-reducing layer. Because this flare-reducing layer had a lower transmission density that that of Example 1, there is less reduction in the film speed.

In the above examples, the flare-reducing layer was contiguous the blue-sensitive silver halide emulsion. While this is the preferred embodiment, it is within the scope of this invention to have the flare-reducing layer adjacent, i.e., spaced from the silver halide emulsion layer by a layer of gelatin. In one such film unit, a flare-reducing layer comprising 4 mg./ft.$^2$ of gelatin and 4 mg./ft.$^2$ of carbon black (Molacco H) was coated over the gelatin anti-abrasion coating of a multicolor dye developer negative of the type described in Example 1, i.e., layer 9 contained gelatin but no carbon black.

As an example of another carbon black useful in flare-reducing layers in accordance with this invention, mention may be made of Aquablak 115 (Binney and Smith Co.). This carbon black exhibits a higher light absorption per unit weight than Molacco H, but it is less preferred since it transmits a little more light in the red region than in the green or blue whereas Molacco H absorbs light uniformly through the visible region.

As disclosed and claimed in the aforementioned U.S. Pat. No. 3,793,022, undesirable reflection from the external surface of the transparent support may be substantially reduced, if not completely eliminated, by providing an anti-reflection coating on the external surface of the transparent support to provide a controlled change in the index of refraction to which incident light is subjected as it passes from air into the transparent support.

The principles of physics by which anti-reflection coatings function are well known and may be used to special advantage in the present invention. Thus, it is well known that application of a single layer transparent coating will reduce surface reflection from a transparent layer (support) if the refractive index of said coating is less than that of the transparent layer to which it is applied and the coating is of appropriate optical thickness. In the photographic products with which this invention is concerned, the anti-reflection coating will normally be in optical contact with air. Under these circumstances, and because the index of refraction of air is 1, the applicable principles of physics give the following rule: if the index of refraction of the coating material (anti-reflection layer) is exactly equal to the square root of the index of refraction of the substrate (transparent support), then all surface reflection of light will be eliminated for that wavelength at which the product of the refractive index times thickness is equal to one-quarter of the wavelength. At other wavelengths the destructive interference between light reflected from the top and bottom surfaces of the anti-reflection coating is not complete but a substantial reduction in overall reflectivity is obtained. By selecting the optical thickness of the anti-reflection coating to be one-quarter of a wavelength for approximately the mid-point of the visible light wavelength range (i.e., one-quarter of 5,500 Angstroms or about 1,400 Angstroms), the reduction in reflectivity is optimized. The term "optical thickness" as used herein refers to the product of the physical thickness of the coating times the refractive index of the coating material.

The anti-reflection coating should be optically clear and provide an essentially uniform layer. In certain embodiments of this invention, the anti-reflection coating is also effective as an anti-abrasion coating. While the above discussion of the applicable principles of physics has concerned itself with a single layer anti-reflection coating, it is also within the scope of this invention to employ an anti-reflection coating comprising several layers, the index of refraction of each layer being selected in accordance with well known principles. In the latter situation, the reduced effectiveness of a single layer in eliminating reflections as the wavelength gets further from the midpoint of the visible light range may be compensated for by appropriate selection of a different wavelength as to which the optical thickness of a second layer should be related. The anti-reflection coating may be organic or inorganic in nature, and many suitable materials are known. Illustrative examples of useful anti-reflection coatings and their method of application are described, e.g., in the above-noted U.S. Pat. No. 3,793,022.

Transparent supports used in integral negative-positive reflection prints include polyesters, polycarbonate, and similar art known polymeric film base materials.

Particularly useful transparent supports are films of polyethylene terephthalate, such as those commercially available under the trademarks "Mylar" (E. I. DuPont de Nemours & Co.) and "Estar" (Eastman Kodak Co.) Such polyester films have an index of refraction on the order of about 1.66. A number of materials suitable for anti-reflection coatings, e.g. fluorinated polymers, have indices of refraction of about 1.33, which is quite close to the 1.29 ideal index of refraction, i.e., the geometric mean of the indices of refraction of the polyethylene phthalate and the surrounding air, or, because the index of refraction of air is 1, the square root of the 1.66 index of refraction of polyethylene terephthalate. Furthermore, the fact that the difference of about 0.3 in the indices of refraction between air and the anti-reflection coating is close to the approximate 0.3 difference in the indices of refraction of the anti-reflection coating and the polyethylene terephthalate support means that maximum benefit will be obtained from the anti-reflection coating; the amplitude of the light entering the anti-reflection coating will more closely match the amplitude of the light reflected back from the interface of the polyethylene phthalate and the anti-reflection coating, and more effectively cancel out the thus reflected light.

As discussed above, the anti-reflection coating or stratum should comprise a material having an index of refraction less than that of the transparent support. The optimum index of refraction to be exhibited by the anti-reflection coating may be readily calculated by the principles of physics previously discussed, but it is not essential that such optimum value be used in order to obtain very beneficial results. In the preferred embodiments of this invention, the transparent support is formed of a polymer having a high index of refraction, e.g., of about 1.6 or higher. The anti-reflection coating preferably has an index of refraction at least 0.20 less than, and more preferably at least 0.25 to 0.3 less than, the index of refraction of the transparent support. Since the preferred transparent supports will have an index of refraction of about 1.6 or higher, the preferred anti-reflection coatings will exhibit an index of refraction of about 1.3 to 1.4.

As set forth above, the transfer image may be in dye or silver and is formed by the diffusion transfer of an imagewise distribution of a diffusible image-forming material, i.e., a dye, dye intermediate, or a soluble silver complex. Since the details of forming transfer images using such diffusible image-forming materials are well known to those skilled in the art, and are described in numerous patents and publications, they have not been repeated herein.

Where the expression "positive image" has been used, this expression should not be interpreted in a restrictive sense since it is used primarily for purposes of illustration, in that it defines the image produced on the image-carrying layer as being reversed, in the positive-negative sense, with respect to the image in the photosensitive emulsion layers. As an example of an alternative meaning for "positive image", assume that the photosensitive element is exposed to actinic light through a negative transparency. In this case, the latent image in the photosensitive emulsion layers will be a positive and the dye image produced on the image-carrying layer will be a negative. The expression "positive image" is intended to cover such an image produced on the image-carrying layer.

Since certain changes may be made in the above product and process without departing from the scope of the invention herein involved, it is intended that all matter contained in the above description or shown in the accompanying drawings shall be interpreted as illustrative and not in a limiting sense.

We claim:

1. A photographic film unit adapted to be exposed and processed to produce a diffusion transfer image comprising, in combination:

a laminate including two support layers, at least one of which is transparent, and intermediate said support layers a plurality of layers including an image-receiving layer and at least one photosensitive silver halide emulsion, said photosensitive silver halide emulsion(s) being photoexposable through said transparent support layer;

a rupturable container of processing composition coupled to said laminate in position to discharge said processing composition for spreading between a predetermined pair of layers of said laminate and thereby cause delamination of said laminate between said predetermined layers thereof;

said laminate including a flare-reducing layer containing a non-diffusible light-absorbing material, said flare-reducing layer being carried by the same support as said photosensitive silver halide emulsion(s), said flare-reducing layer being positioned between said photosensitive silver halide emulsion(s) and said transparent support through which photoexposure of said photosensitive silver halide emulsion(s) is effected, said transparent support having a higher index of refraction than the binder material of said first silver halide layer;

said rupturable container being so positioned as to distribute its contents between said flare-reducing layer and said transparent support through which photoexposure is effected;

said film unit including means providing a light-reflecting layer of a white pigment between said flare-reducing layer and said image-receiving layer to provide a white background for said image-receiving layer and to mask the developed silver halide emulsion(s) and said flare-reducing layer, and means providing a diffusible image-forming material for transfer to said image-receiving layer, the support carrying said image-receiving layer being transparent.

2. A photographic film unit as defined in claim 1 wherein said flare-reducing layer has a transmission density not in excess of about 0.3.

3. A photographic film unit as defined in claim 1 wherein said light-absorbing material in said flare-reducing layer is carbon black.

4. A photographic film unit as defined in claim 1 wherein said transparent support through which photoexposure is effected has an index of refraction of at least about 1.6.

5. A photographic film unit as defined in claim 4 wherein said transparent support is a polyester.

6. A photographic film unit as defined in claim 5 wherein said polyester is polyethylene terephthalate.

7. A photographic film unit as defined in claim 6 wherein said polyethylene terephthalate contains an anti-light-piping quantity of carbon black.

8. A photographic film unit as defined in claim 1 wherein said photosensitive layer(s) are carried by an opaque support, and said image-receiving layer is carried by said transparent support through which photoexposure is effected.

9. A photographic film unit as defined in claim 1 wherein an anti-reflection coating is present on the outer surface of said transparent support through which photoexposure is effected.

10. A photographic film unit as defined in claim 1 wherein an anti-reflection coating is present on the outer surface of said transparent support through which an image formed in said image-receiving layer may be viewed.

11. A photographic film unit as defined in claim 1 wherein each said photosensitive silver halide emulsion has associated therewith a diffusion transfer process image dye-providing material; and said image-receiving layer is adapted to receive image dyes provided by said image dye-providing materials.

12. A photographic film unit as defined in claim 11 wherein said photosensitive silver halide emulsions include a red-sensitive silver halide layer having associated therewith a cyan image dye-providing material, a green-sensitive silver halide layer having associated therewith a magenta image dye-providing material, and a blue-sensitive silver halide layer having associated therewith a yellow image dye-providing material.

13. A photographic film unit as defined in claim 11 wherein said photosensitive silver halide emulsions include a red-sensitive silver halide layer having associated therewith a cyan dye developer, a green-sensitive silver halide layer having associated therewith a magenta dye developer, and a blue-sensitive silver halide layer having associated therewith a yellow dye developer.

14. A photographic film unit as defined in claim 1 wherein said processing composition includes a white pigment, and said rupturable container is so positioned as to distribute its contents between said flare-reducing layer and said image-receiving layer and thereby provide said light-reflecting layer.

15. A photographic film unit as defined in claim 1 wherein both said supports are transparent, and said image-receiving layer and said silver halide emulsion(s) are carried by the same support with said light-reflecting layer of a white pigment therebetween.

16. A photographic film unit as defined in claim 1 wherein said predetermined layers are temporarily bonded to each other by a stratum including a water-soluble polymer.

17. A photographic film unit as defined in claim 16 wherein said water-soluble polymer is a polyethylene glycol.

18. A photographic film unit as defined in claim 1 wherein said processing composition includes a silver halide solvent and said image-receiving layer includes a silver precipitating agent.

19. A photographic film unit as defined in claim 1 wherein said flare-reducing layer contains about 3 to about 5 mg./ft.$^2$ of carbon.

20. A photographic film unit as defined in claim 1 wherein said flare-reducing layer has a transmission density of about 0.1 to about 0.3.

21. A photographic film unit as defined in claim 1 wherein said flare-reducing layer is a carbon containing gelatin layer having a transmission density of approximately 0.15.

22. A photographic film unit as defined in claim 1 wherein said flare-reducing layer is a carbon containing gelatin layer having a transmission density of approximately 0.2.

23. A photographic laminate comprising, in sequence, an opaque polyester support, a cyan dye developer layer, a red-sensitive silver halide emulsion layer, a polymeric interlayer, a magenta dye developer layer, a green-sensitive silver halide emulsion layer, a polymeric interlayer, a yellow dye developer layer, a blue-sensitive silver halide emulsion layer, a gelatin layer containing carbon black in a quantity effective to impart to said gelatin layer a transmission density of about 0.1 to about 0.3, a layer of a high molecular weight polyethylene glycol, an image-receiving layer, a spacer layer, a polymeric acid layer, and a transparent polyester support.

24. A photographic laminate as defined in claim 23 wherein the transmission density of said carbon containing gelatin layer is approximately 0.2.

25. A photographic laminate as defined in claim 23 wherein the transmission density of said carbon containing gelatin layer is approximately 0.15.

26. A photographic laminate as defined in claim 23, including an anti-reflection layer coated on the outer surface of said transparent polyester support.

27. A photographic film unit comprising a first support and a second support, both said supports being transparent; a plurality of layers including at least one photosensitive silver halide emulsion layer carried on one of said supports; a rupturable container releasably holding a processing composition adapted, when distributed between a pair of predetermined layers carried by said supports, to develop said photosensitive silver halide emulsion layer(s) and provide a diffusion transfer image in an image-receiving layer carried on the same support as said silver halide emulsion layer(s); a light-reflecting layer of a white pigment between said image-receiving layer and said silver halide emulsion layer(s) to mask said silver halide emulsion layer(s) after development thereof and to provide a white background for a diffusion transfer image formed in said image-receiving layer, said diffusion transfer image being viewable through said transparent support carrying said image-receiving layer said supports and the layers carried thereon being held in fixed relationship with said photosensitive silver halide emulsion layer(s) being photoexposable through a transparent support; said film unit including a flare-reducing layer carried by the same support as said phtosensitive silver halide emulsion layer(s), said flare-reducing layer containing a non-diffusible light-absorbing material and being positioned between said photosensitive silver halide emulsion layer(s) and the transparent support through which photoexposure is effected; said flare-reducing layer being so positioned as to be masked by said light-reflecting layer; said rupturable container being so positioned as to distribute its contents between said flare-reducing layer and the transparent support through which photoexposure is effected.

28. A photographic film unit as defined in claim 27 wherein said predetermined layers are temporarily bonded to each other by a stratum including a water-soluble polymer.

29. A photographic film unit as defined in claim 27 wherein said layers are held in said fixed relationship by binder means along at least two parallel sides of said film unit.

30. A photographic film unit as defined in claim 27 including an anti-reflection layer coated on the outer surface of at least one said transparent support.

31. A photographic film unit as defined in claim 27 wherein said flare-reducing layer contains carbon in a coverage effective to provide a transmission density of about 0.1 to about 0.3.

32. A photographic film unit as defined in claim 27 wherein each said transparent support has an index of refraction higher than gelatin.

33. A photographic film unit as defined in claim 27 wherein said transparent support through which photoexposure is effected is a polyethylene terephthalate film base containing an anti-light-piping quantity of carbon black.

34. In a diffusion transfer process for providing an integral negative-positive reflection print, said process including the steps of exposing a photosensitive silver halide emulsion through a transparent support; developing said photoexposed silver halide emulsion with an aqueous alkaline processing composition and, as a function of said development, forming an imagewise distribution of a diffusible imageforming component, transferring at least a portion of said imagewise distribution to an image-receiving layer in superposed relationship with said silver halide emulsion to impart thereto a diffusion transfer image; said image-receiving layer and said developed silver halide emulsion being maintained as a laminate providing said integral negative-positive reflection print, said diffusion transfer image in said image-receiving layer being viewable through a transparent support for said image-receiving layer, a layer of a light-reflecting material being positioned between said image-receiving layer and said developed silver halide emulsion to mask said developed silver halide emulsion from view and to provide a background for viewing said diffusion transfer image; said exposure of said silver halide emulsion being effected through a flare-reducing layer containing a non-diffusible light-absorbing material, said flare-reducing layer being carried by the same support as said silver halide emulsion and positioned between said silver halide emulsion and said transparent support through which said exposure was effected, said flare-reducing layer being so positioned as to be masked by said layer of light-reflecting material when said diffusion transfer image is viewed, said processing composition being distributed between said flare-reducing layer and said transparent support through which said exposure was effected.

35. A process as defined in claim 34 wherein said non-diffusible light-absorbing material is carbon black.

36. A process as defined in claim 35 wherein said flare-reducing layer has a transmission density of about 0.1 to about 0.3.

37. A process as defined in claim 34 wherein said transparent support through which said exposure was effected is a polyethylene terephthalate film base containing an anti-light-piping quantity of carbon black.

* * * * *